US006835110B2

(12) United States Patent
Mizuno et al.

(10) Patent No.: US 6,835,110 B2
(45) Date of Patent: Dec. 28, 2004

(54) METHOD FOR MANUFACTURING ELECTRON SOURCE AND METHOD FOR MANUFACTURING IMAGE DISPLAY APPARATUS

(75) Inventors: Hironobu Mizuno, Kanagawa (JP); Masaharu Naka, Kanagawa (JP); Koki Nukanobu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 10/212,758

(22) Filed: Aug. 7, 2002

(65) Prior Publication Data

US 2003/0039767 A1 Feb. 27, 2003

(30) Foreign Application Priority Data

Aug. 9, 2001 (JP) ..... 2001/241972
Jul. 26, 2002 (JP) ..... 2002/217791

(51) Int. Cl.[7] ..... H01J 9/02
(52) U.S. Cl. ..... 445/6; 445/24
(58) Field of Search ..... 445/6, 24

(56) References Cited

U.S. PATENT DOCUMENTS 6,053,791 A * 4/2000 Fujii et al. ..... 445/6
6,123,876 A 9/2000 Kobayashi et al. ..... 252/519.2
6,179,678 B1 1/2001 Kishi et al. ..... 445/24

(List continued on next page.)

FOREIGN PATENT DOCUMENTS

EP 0 736 890 A1 10/1996
EP 0 788 130 A2 8/1997
EP 0 803 890 A1 10/1997
EP 0 986 085 A2 3/2000
EP 1 184 886 A1 3/2002 ..... H01J/9/02
JP 7-65704 3/1995
JP 7-235255 9/1995
JP 8-55563 2/1996
JP 8-321254 12/1996
JP 9-161666 6/1997
JP 9-237571 9/1997
JP 2-903295 3/1999
JP 11-120901 4/1999 ..... H01J/9/02
JP 2000-58133 2/2000

OTHER PUBLICATIONS

Baba et al., "Field Emission from an Ion–Beam–Modified Polyimide Film," Jpn. J. Appl. Phys., V. 38, pp. L 261–L263 (1999).

*Primary Examiner*—Kenneth J. Ramsey
(74) *Attorney, Agent, or Firm*—Fitzpatrick, Cella, Harper & Scinto

(57) ABSTRACT

To provide a method for manufacturing an electron source having electron-emitting devices with excellent electron-emitting property arranged on a substrate and enabling an image-forming apparatus capable of displaying an image with high brightness and uniformity to be enhanced in terms of screen size and production scale. The method for manufacturing the electron source includes a step of disposing a plurality of units and a plurality of wirings connected to the plurality of units on a substrate, each unit including a polymer film and a pair of electrodes with the polymer film interposed therebetween, and a step of forming electron-emitting devices from the plurality of units by repeatedly performing a process including a selecting substep of selecting a desired number of units from the plurality of units, a resistance-reducing substep of reducing resistance of the polymer films of the selected units and a gap-forming substep of forming a gap in each of the films formed by the resistance-reducing substep.

12 Claims, 15 Drawing Sheets

U.S. PATENT DOCUMENTS

| | | | | |
|---|---|---|---|---|
| 6,221,426 | B1 | 4/2001 | Yamanobe | 427/77 |
| 6,246,168 | B1 | 6/2001 | Kishi et al. | 313/495 |
| 6,334,803 | B1 | 1/2002 | Shibata | 445/51 |
| 6,383,047 | B1 | 5/2002 | Minami et al. | 445/6 |
| 6,503,831 | B2 * | 1/2003 | Speakman | 438/674 |
| 6,566,794 | B1 * | 5/2003 | Miyazaki | 313/292 |
| 2002/0117670 | A1 | 8/2002 | Horiguchi et al. | 257/59 |
| 2003/0073371 | A1 | 4/2003 | Iwaki | 445/24 |
| 2003/0160180 | A1 | 8/2003 | Arai et al. | 250/424 |
| 2003/0161942 | A1 | 8/2003 | Arai et al. | 427/77 |
| 2003/0162464 | A1 | 8/2003 | Kyogaku et al. | 445/24 |
| 2003/0162465 | A1 | 8/2003 | Mizuno et al. | 445/24 |
| 2003/0162467 | A1 | 8/2003 | Shimazu et al. | 445/50 |

* cited by examiner

METHOD FOR MANUFACTURING ELECTRON SOURCE AND METHOD FOR MANUFACTURING IMAGE DISPLAY APPARATUS

BACKGROUND OF THE INVENTION

1. Field of the Invention

The present invention relates to a method for manufacturing an electron source comprising a large number of electron-emitting devices arranged and a method for manufacturing a display apparatus including the electron source.

2. Related Background Art

The electron-emitting devices include a field emission electron-emitting device, a metal/insulator/metal electron-emitting device and a surface conduction electron-emitting device. An arrangement, manufacturing method and the like of the surface conduction electron-emitting device are disclosed in Japanese Patent Application Laid-Open No. 7-235255 and Japanese Patent No. 2903295, for example.

Now, the surface conduction electron-emitting device disclosed in the specifications will be outlined in brief.

As schematically shown in FIG. 14, the surface conduction electron-emitting device comprises a substrate 1, a pair of device electrodes 2, 3 facing each other on the substrate 1, and an electroconductive film 144 including an electron-emitting region 145 and connected to the device electrodes.

The electron-emitting region 145 is formed in the following manner. First, the electroconductive film 144 is placed to interconnect the electrodes 2 and 3, and then, a process step referred to as a "forming" is carried out. In this step, a voltage is applied across the electrodes 2 and 3 in a high vacuum to pass a current through the electroconductive film 144, thereby forming a gap in the part of electroconductive film 144. Then, a process step referred to as an "activation" is carried out. In this step, a deposit 146 mainly composed of carbon and/or carbon compound is provided in the gap formed by the "forming" and on the electroconductive film in the vicinity of the gap.

In this way, carrying out the "forming" and the "activation" provides the electron-emitting region 145. Here, the deposit 146 comprises two parts facing each other with a gap in-between, the gap being narrower than the gap formed in the electroconductive film 144. In the activation step, a pulsed voltage is applied to the device in an atmosphere containing an organic material. Then, as the deposit 146 mainly composed of carbon and/or carbon compound accumulates, a current passing through the device (device current If) and a current emitted to the vacuum (emission current Ie) are substantially increased, whereby better electron-emitting property can be provided.

Besides, in Japanese Patent Application Laid-Open No. 9-237571, there is disclosed a method for manufacturing an electron-emitting device, the method including, instead of the "activation" step, a step of applying an organic material, such as a thermosetting resin, an electron beam polymerization type negative resist and polyacrylonitrile, on the electroconductive film and a step of carbonizing the same.

Then, combining the electron source comprising a plurality of such electron-emitting devices with a light-emitting member such as a phosphor or the like can provide an image-forming apparatus, such as a flat panel display.

SUMMARY OF THE INVENTION

As for the electron source comprising a plurality of electron-emitting devices and the image display apparatus, it has been demanded that the manufacturing methods therefor are simple, and an image can be displayed on a large screen for a long time with high definition, brightness and uniformity.

Thus, for the electron source or image display apparatus involving the surface conduction electron-emitting devices, it is desired to provide a further simplified manufacturing process as well as a further enhanced uniformity in electron-emitting property between the devices.

Therefore, an object of this invention is to provide simple methods for manufacturing an electron source with excellent and highly uniform electron-emitting property and an image display apparatus including the electron source.

To attain the object, this invention has been devised as follows.

Specifically, according to this invention, there is provided a method for manufacturing an electron source, comprising:

(A) a step of disposing a plurality of units and a plurality of wirings connected to the plurality of units on a substrate, each unit comprising a polymer film (an organic polymer film) and a pair of electrodes with the polymer film interposed therebetween; and (B) a step of forming electron-emitting devices from the plurality of units by sequentially repeating a process including a selecting substep of selecting a desired number of units from the plurality of units, a resistance-reducing substep of reducing resistance of the polymer films of the selected units and a gap-forming substep of forming a gap in each of the films obtained by the resistance-reducing substep.

Preferably, in the method for manufacturing an electron source according to this invention, the number of the units selected at one time is two or more.

Preferably, the gap is formed by passing a current through the film obtained by the resistance-reducing substep.

Preferably, the plurality of wirings comprises a plurality of row-directional wirings and a plurality of column-directional wirings crossing the row-directional wirings with an insulating layer interposed therebetween, and each of the plurality of units is connected to one of the plurality of row-directional wirings and one of the plurality of column-directional wirings.

Preferably, the selected units are a plurality of units connected to a same row-directional wiring or same column-directional wiring.

Preferably, the resistance of the polymer film is reduced by irradiating the polymer film with an energy beam.

Preferably, the energy beam is emitted from a plurality of energy beam irradiation source.

Preferably, the energy beam is an electron beam.

Preferably, the energy beam is a light beam.

Preferably, the energy beam is a laser beam.

Preferably, the energy beam is an ion beam.

Furthermore, according to this invention, there is provided a method for manufacturing a display apparatus having an electron source comprising a plurality of electron-emitting devices and a light emitting member that emits light in response to being irradiated with an electron emitted from the electron source, in which the electron source is manufactured by the method for manufacturing an electron source according to this invention described above.

According to this invention, a large number of polymer films (organic polymer films) can be reduced in resistance (conductivity can be imparted thereto), and a gap can be formed in each of a large number of the films obtained by reducing resistance of the large number of polymer films. That is, a large number of polymer films (organic polymer films) are formed, some (typically one) polymer film(s) selected among therefrom is/are transformed (reduced in resistance) to impart a sufficient conductivity thereto, and a current is applied to the transformed film(s) to form a gap in each film. Then, other (another) polymer film(s) is/are transformed to impart a sufficient conductivity thereto, and a current is applied to the transformed film(s) to form a gap in each film. Such a process is sequentially repeated. Thus, the gaps can be formed on all the transformed films eventually.

One effective method for reducing the resistance of some or one polymer film(s) is to transform the polymer film(s) by irradiating the polymer film(s) with an electron beam, light beam or ion beam. Using the electron beam, light beam or ion beam enables the resistance of only the selected polymer film(s) to be reduced in a relatively short time, and therefore, the power required for the "forming" can be distributed in terms of time. Thus, enhancement in screen size and production scale can be readily realized, and the electron-emitting devices with uniform property can be arranged over the whole display region.

With the manufacturing method according to this invention, an electron source with high efficiency capable of maintaining a highly uniform electron-emitting property for a long time can be manufactured. Thus, with the manufacturing method according to this invention, an image display apparatus capable of displaying a stable image with high brightness and uniformity for a long time can be manufactured.

DESCRIPTION OF THE PREFERRED EMBODIMENTS

Now, preferred embodiments of this invention will be described. The following description will be made by taking a surface conduction electron-emitting device as an example herein.

Figure 4A:
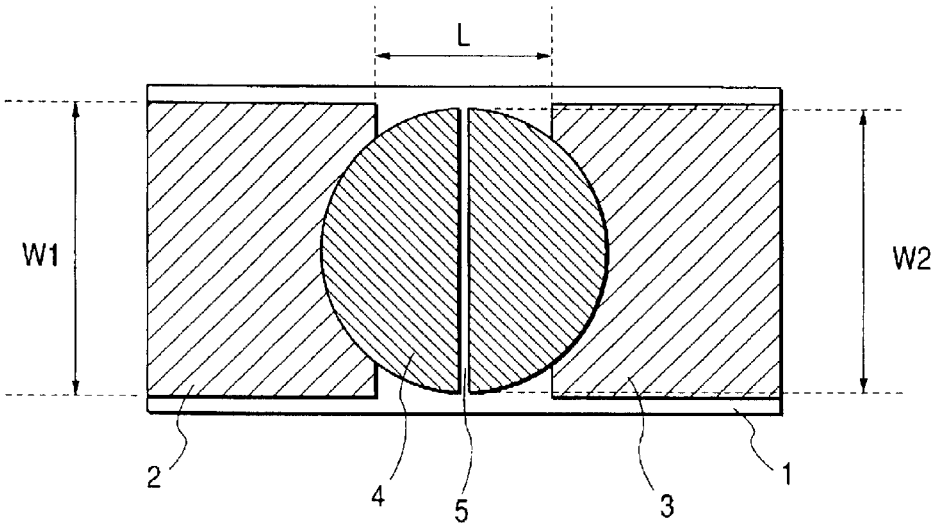
FIGS. 4A and 4B show basic examples of a configuration of a surface conduction electron-emitting device according to this invention.
Figure 4B:
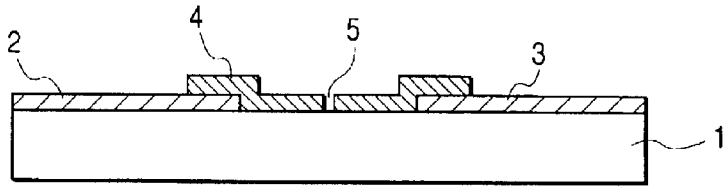

FIGS. 4A and 4B are schematic diagrams showing a configuration of one electron-emitting device constituting an electron source manufactured according to a manufacturing method of this invention, in which FIG. 4A is a plan view and FIG. 4B is a cross-sectional view. In FIGS. 4A and 4B, reference numeral 1 denotes a substrate, reference numerals 2 and 3 denote electrodes (device electrodes), reference numeral 4 denotes a carbon film and reference numeral 5 denotes a gap. Here, including reference numerals 4 and 5 refers to a carbon film with a gap.

The carbon film 4 involves at least bond between carbon atoms, and is preferably a "pyrolytic polymer". The "pyrolytic polymer" used herein refers to an electroconductive one resulting from heating of a polymer (organic polymer). However, those formed through pyrolysis and recombination by a factor other than heat, such as electron beam and photon, in addition to pyrolysis and recombination by heat are also referred to as the "pyrolytic polymer".

Typically, the thickness of the carbon film 4 preferably falls within a range from several tenths to several hundreds nanometers, and more preferably, within a range from 1 nm to 100 nm.

Figure 5:
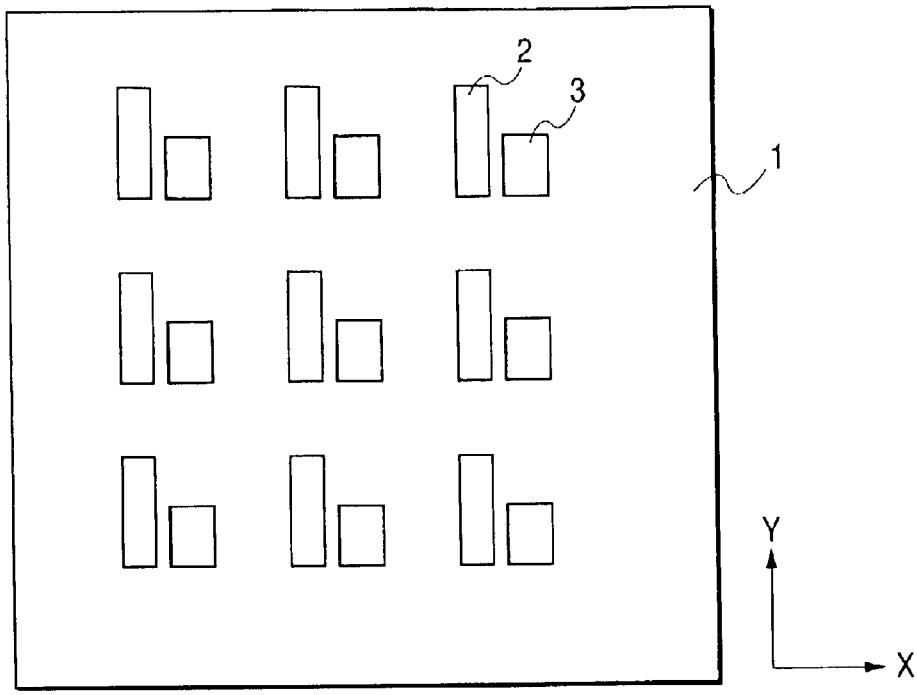
FIG. 5 illustrates a process step in an exemplary method for manufacturing an electron source according to this invention.

FIGS. 5 to 11 schematically illustrate one example of a method for manufacturing an electron source according to this invention comprising a large number of the electron-emitting devices shown in FIGS. 4A and 4B. Referring to FIGS. 4A and 4B and FIG. 5, the example of the method for manufacturing an electron source according to this invention will be described. For the sake of simplification, nine electron-emitting devices are arranged in a matrix in FIGS. 5 to 11. However, according to this invention, the number of the electron-emitting devices is not limited particularly.

(Step 1)

The substrate 1 is adequately cleaned with a detergent, pure water, organic solvent or the like, a material for the device electrodes is deposited thereon by vacuum evaporation, sputtering or the like, and then, a plurality of device electrodes 2 and 3 are formed on the substrate 1 with a photolithography technique (see FIG. 5).

A quartz glass, a glass having a reduced content of an impurity including Na, a soda lime glass, a laminate comprising a soda lime glass and an insulating layer of $SiO_2$, SiN or the like deposited thereon by sputtering or the like, a ceramic substrate such as of alumina, or a Si substrate may serve as the substrate 1.

The material of the device electrodes 2, 3 facing each other may be a common conductive material, and may be appropriately selected among from a printed conductor composed of a metal including Ni, Cr, Au, Mo, W, Pt, Ti, Al, Cu and Pd or alloy thereof or metal including Pd, Ag, Au, $RuO_2$ and Pd—Ag or metal oxide thereof and a glass or the like, a transparent conductor such as $In_2O_3$—$SnO_2$ and a semiconductor material such as polysilicon. In particular, a noble metal such as platinum is preferably used. However, in the case of a light irradiation process as described later, an oxide conductor which is transparent, specifically, a film of tin oxide or indium tin oxide (ITO) may be used as required.

As shown in FIG. 4A, a distance L between the device electrodes, a length W1 of the device electrode, a width W2 of the carbon film 4 and the like are determined in consideration of the configuration to which the device is applied, or the like. The distance L between the device electrodes preferably falls within a range from several hundreds nanometers to several hundreds micrometers, and more preferably, a range from several to several tens micrometers. The length W1 of the device electrode falls within a range from several to several hundreds micrometers in consideration of the resistance value and electron-emitting property of the electrode. A thickness d of the device electrodes 2, 3 falls within a range from several tens nanometers to several micrometers.

(Step 2)

Figure 6:
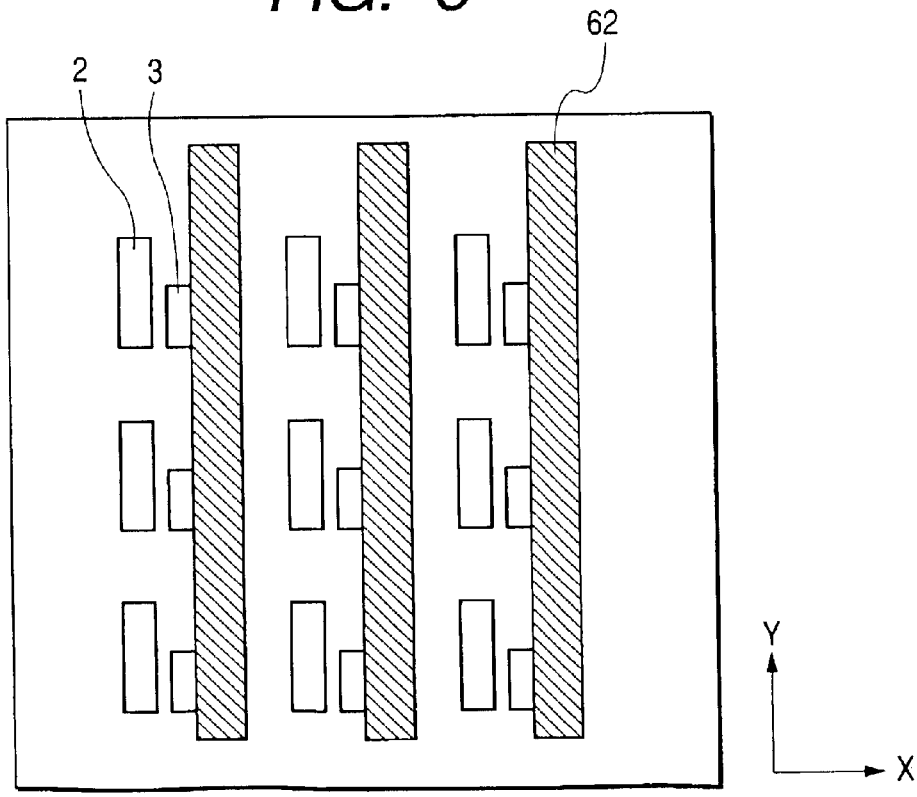
FIG. 6 illustrates a process step in the exemplary method for manufacturing an electron source according to this invention.
Figure 7:
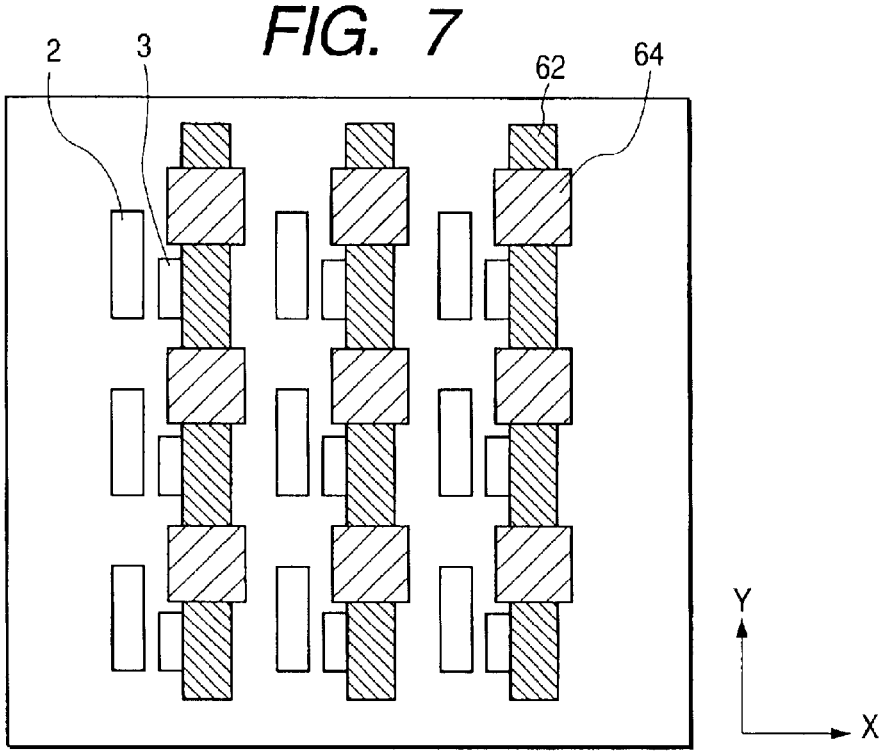
FIG. 7 illustrates a process step in the exemplary method for manufacturing an electron source according to this invention.
Figure 8:
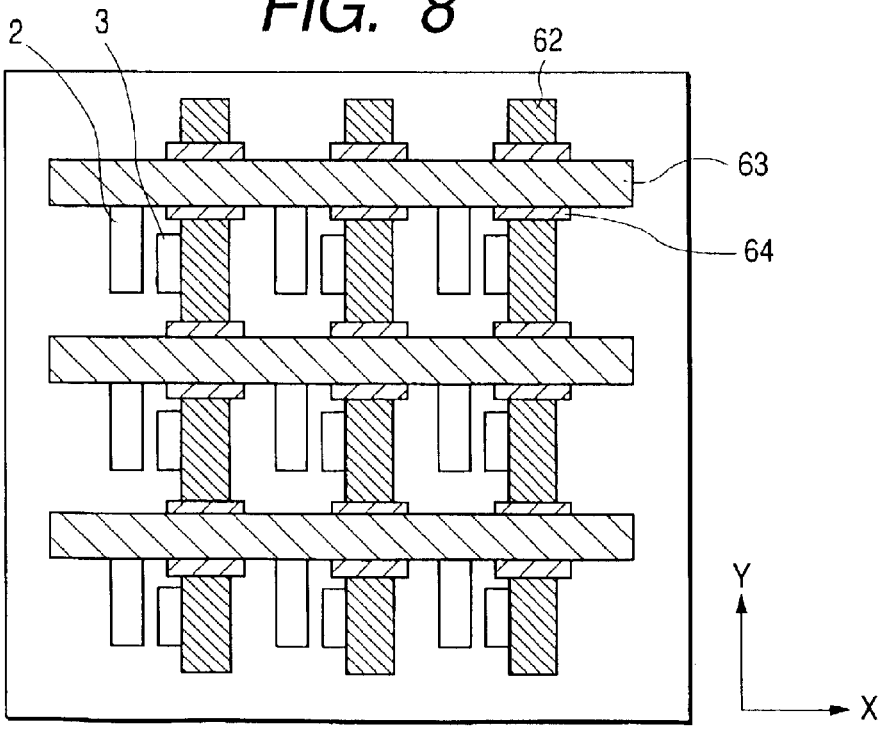
FIG. 8 illustrates a process step in the exemplary method for manufacturing an electron source according to this invention.

A plurality of y-directional wirings 62 and x-directional wirings 63 electrically connected to the electrode pairs 2, 3, and insulating layers 64 disposed between the x-directional wiring and the y-directional wiring are formed (FIGS. 6 to 8). The wirings 62 and 63 may be formed by screen printing, for example. However, the forming method thereof is not limited particularly. Furthermore, the material of the wirings is not limited particularly and may be any material, such as Ag, as far as it has a sufficient conductivity. The insulating layer 64 also may be formed by screen printing, for example. However, the forming method thereof is not limited particularly. Also, the material of the insulating layer is not limited particularly and may be any material, such as $SiO_2$, as far as it provides insulation enough to prevent a short-circuit between the wirings 62 and 63.

(Step 3)

Figure 9:
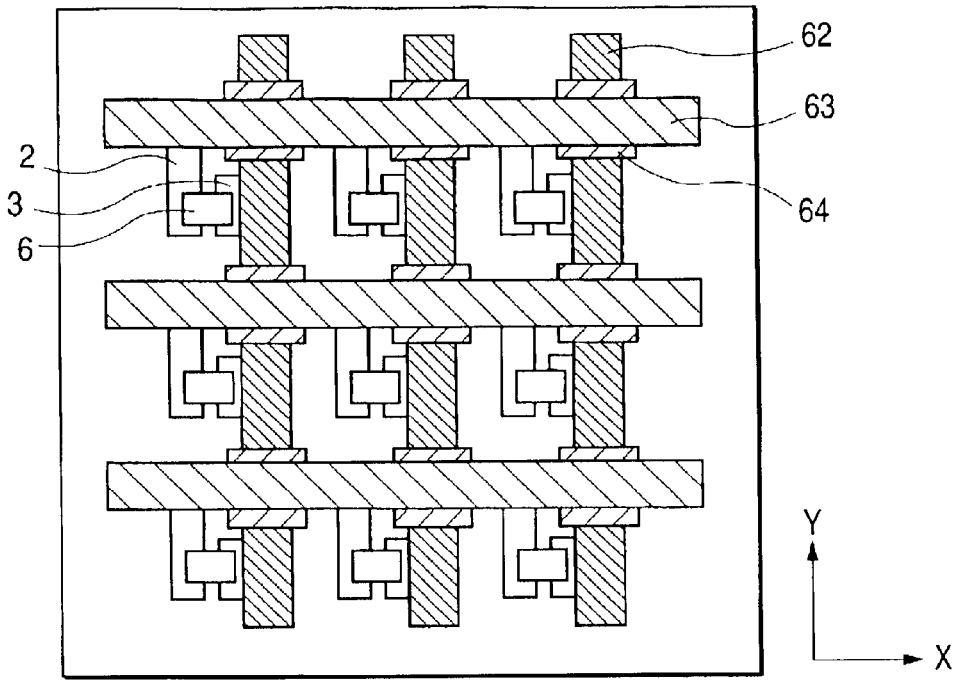
FIG. 9 illustrates a process step in the exemplary method for manufacturing an electron source according to this invention.

In each of the electrode pairs, the polymer film (organic polymer film) 6 is formed between the device electrodes 2 and 3 (FIG. 9). In this step, a plurality of units each comprising one pair of electrodes 2, 3 and the polymer film 6 are formed on the substrate 1.

For the polymer film 6, a polymer that readily provides conductivity due to decomposition and recombination of the bond between the carbon atoms, that is, is likely to produce a double bond between the carbon atoms, is preferably used. Among such polymers, aromatic polymers are preferred. In particular, aromatic polyimides provide a pyrolytic polymer having a high conductivity at a relatively low temperature. The aromatic polyimides are insulators in themselves. However, there are also polyphenylene oxadiazole and polyphenylene vinylene, which have conductivity even before pyrolysis. Such conductive polymers also can be preferably used, because they further provide conductivity due to the pyrolysis.

The polymer film 6 may be formed by various well-known methods including spin-coating, printing and dipping. Among others, the printing method is preferably used, because it enables the polymer film 6 to be formed into a desired shape without any patterning means. In particular, an ink-jet printing method enables a microscopic pattern on the order of several hundreds micrometers or less to be directly formed, and therefore, is useful to manufacture such an electron source having the electron-emitting devices arranged with high density as to be applied to the flat panel display. In the case of forming the polymer film 6 by the ink-jet printing method, a droplet of a solution of the polymer material may be applied to the substrate and then dried. Alternatively, a droplet of a precursor solution for the desired polymer may be applied to the substrate and then polymerized by heating or the like, as required.

According to this invention, aromatic polymers are preferably used, in particular. However, since most of the aromatic polymers are hard to be dissolved in a solvent, the method of applying the precursor solution therefor is useful. For example, a solution of polyamic acid, which is a precursor of aromatic polyimides, may be applied to the substrate by the ink-jet method (in the form of a droplet) to form a polyimide film by heating or the like. Here, the solvent for the precursor of the polymer to be dissolved therein may be N-methylpyrrolidone, N,N-dimethylacetamide, N,N-dimethylformamide, dimethyl sulfoxide or the like, which may be used in conjunction with n-butyl cellosolve, triethanolamine or the like. However, the solvent is not limited particularly to these, as far as this invention can be applied thereto.

(Step 4)

Figure 10:
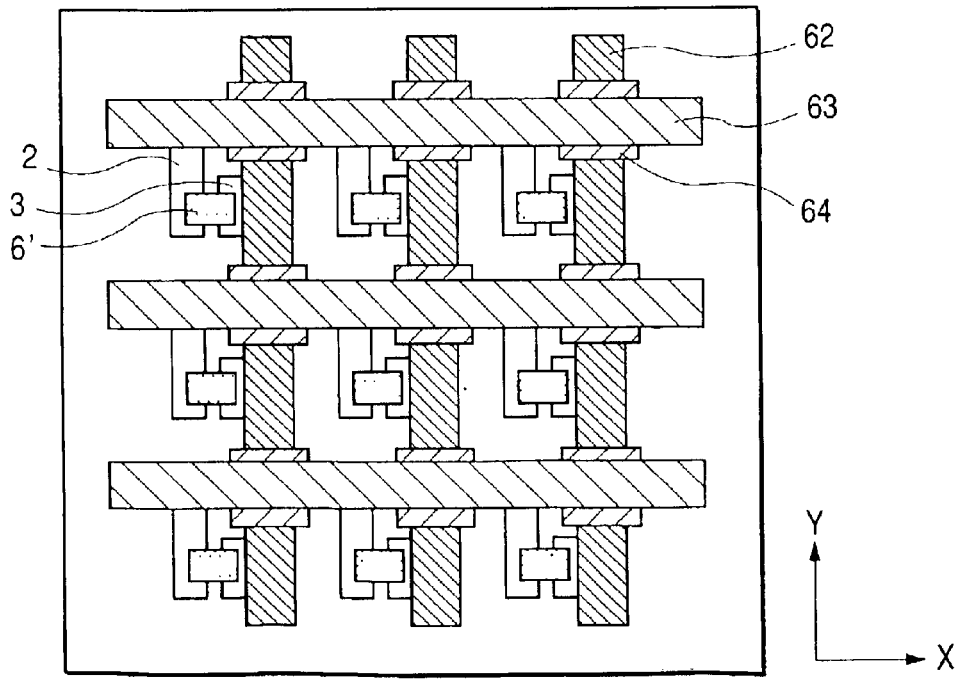
FIG. 10 illustrates a process step in the exemplary method for manufacturing an electron source according to this invention.
Figure 11:
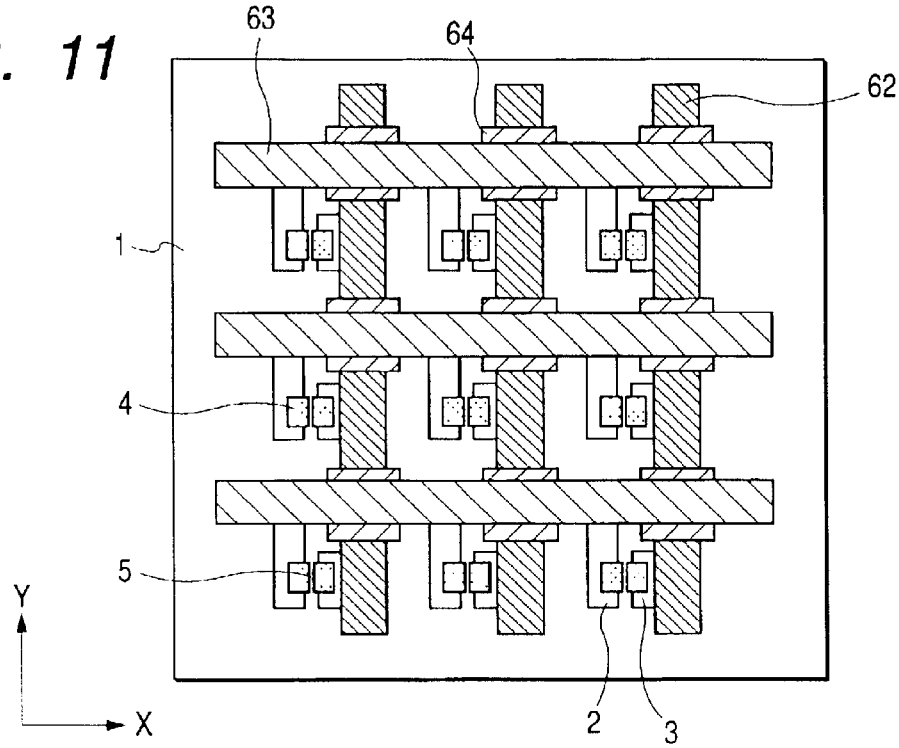
FIG. 11 illustrates a process step in the exemplary method for manufacturing an electron source according to this invention.

Then, the polymer film 6 is subject to a resistance reducing processing to provide a film 6' with a reduced resistance ("resistance reducing process" is performed) (as shown in FIG. 10). Then, a gap 5 is formed in the film 6' ("gap forming process" is performed) (as shown in FIG. 11). Thus, the carbon film 4 with a gap has been formed. The gaps is formed in the film 6' with a reduced resistance by passing a current through the film 6'.

By the steps described above, the electron source having a plurality of electron-emitting devices arranged is formed.

According to this invention, the "pyrolysis processing" is used for reducing the resistance of the polymer film 6. The "pyrolysis processing" refers to a processing of increasing conductivity by using heat to cause decomposition and recombination of bonds between carbon atoms in the polymer.

According to one example of the method for reducing the resistance of the polymer film 6, in an environment in which no oxidation occurs, such as in an atmosphere of inert gas or in a vacuum, the polymer film 6 is heated at a temperature higher than the decomposition temperature of the polymer constituting the polymer film 6. The aromatic polymer, in particular, the aromatic polyimide has a high pyrolysis temperature for a polymer, and by heating the aromatic polyimide at a temperature higher than the pyrolysis temperature, typically from 700 to 800 degrees Celsius, a pyrolytic polymer with high conductivity can be provided.

However, in the case where the pyrolysis polymer is used for a component of the electron-emitting device, such as in this invention, the method of heating the whole device with an oven or hot plate will be often restricted in consideration of heat-resistance of other components. In particular, the substrate 1 is limited to those having especially high heat resistance, such as a quartz glass and ceramic substrate. And thus, applying the method to a large area display panel will be quite expensive.

In order to solve the problem, according to this invention, the polymer film 6 is irradiated with an energy beam, such as electron beam, light beam and ion beam, to reduce the resistance thereof, and thus, the resistance reducing processing is accomplished without expensive substrate having high heat resistance. Among others, the electron beam or laser beam is preferably used, and in particular, the electron beam is preferably used.

Now, the resistance reducing processings involving electron beam irradiation, light beam irradiation and ion beam irradiation will be described, respectively.

(Electron Beam Irradiation)

Figure 12:
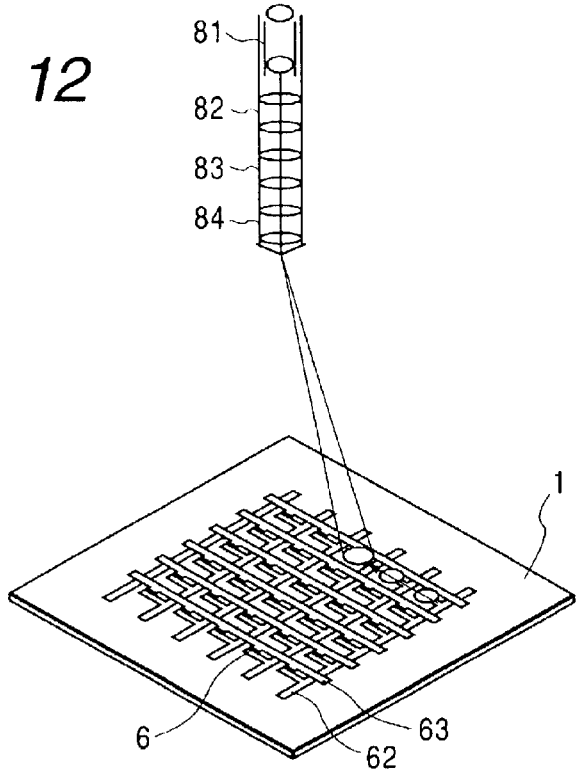
FIG. 12 is a diagram for illustrating a step of reducing a resistance of a polymer film using an electron beam irradiator according to this invention.

FIG. 12 is a schematic diagram for illustrating irradiation of the polymer films 6 arranged in a matrix on the substrate 1 with an electron beam. In FIG. 12, reference numeral 81 denotes an electron-emitting means. As for the electron-emitting means 81, a thermionic cathode may serve as an electron beam source, for example. And, the substrate 1 after the step 3 may be disposed in a depressurized atmosphere, and a potential difference may be applied between the substrate 1 and the electron-emitting means 81, thereby irradiating the polymer films 6 on the substrate 1 with electrons emitted from the electron-emitting means.

The polymer films 6 arranged in a matrix may be irradiated with the electron beam by a method of scanning the substrate 1 with a fixed electron beam by mounting the substrate 1 on a table which is movable in x and y directions and moving the table in the x and y directions, method of moving the electron beam in the x and y directions to scan the fixed substrate 1, or method of scanning the substrate with the electron beam by moving in the x direction the substrate 1 mounted on a table which is movable in the x direction and, in synchronization therewith, moving the electron beam in the y direction.

For scanning with the electron beam, an electrode 84 may be additionally provided to focus or deflect the electron beam using an electric field or magnetic field. In addition, electron beam blocking means 83 may be provided to precisely control the electron beam irradiation region. Depending on the use conditions, both or either of the electrode 84 and the blocking means 83 may be provided.

While the polymer film 6 may be irradiated with the electron beam in a direct current manner, it is preferably irradiated with the electron beam in a pulsed manner. In particular, the pulsed irradiation of the electron beam is preferably used for scanning with the electron beam.

Of the conditions of electron beam irradiation, for example, an acceleration voltage (Vac) is preferably equal to or higher than 0.5 kV and equal to or lower than 10 kV, and a current density (ρ) is preferably equal to or higher than 0.01 $mA/mm^2$ and equal to or lower than 1 $mA/mm^2$.

(Light Beam Irradiation)

As the "light beam" in this invention, a laser beam, a light beam of condensed visible light or the like may be preferably used.

The light source is not limited particularly. However, an Nd:YAG second harmonic light source capable of producing high power is preferably used for the laser beam, or an Xe light source or the like capable of producing high power is used for the visible light beam, for example.

Figure 13A:
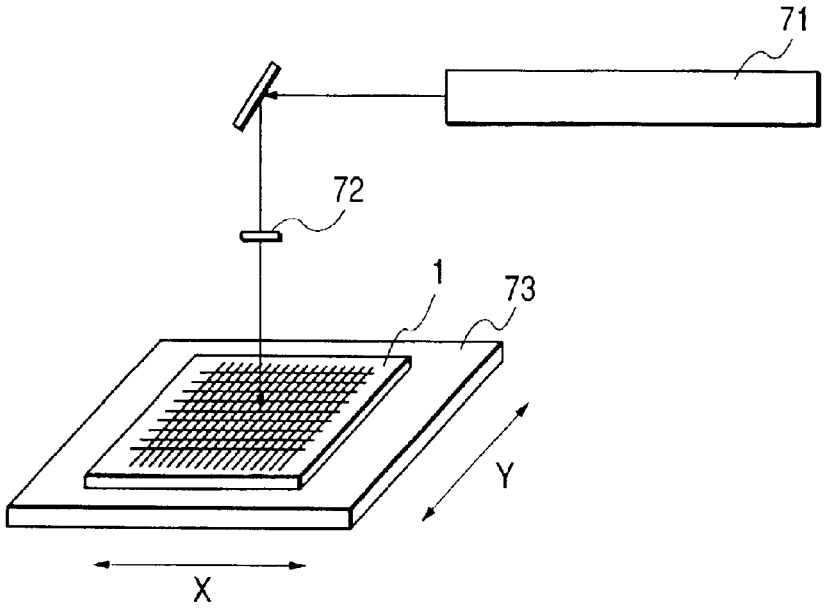
FIGS. 13A and 13B are diagram for illustrating a step of reducing a resistance of a polymer film using a light source according to this invention.
Figure 13B:
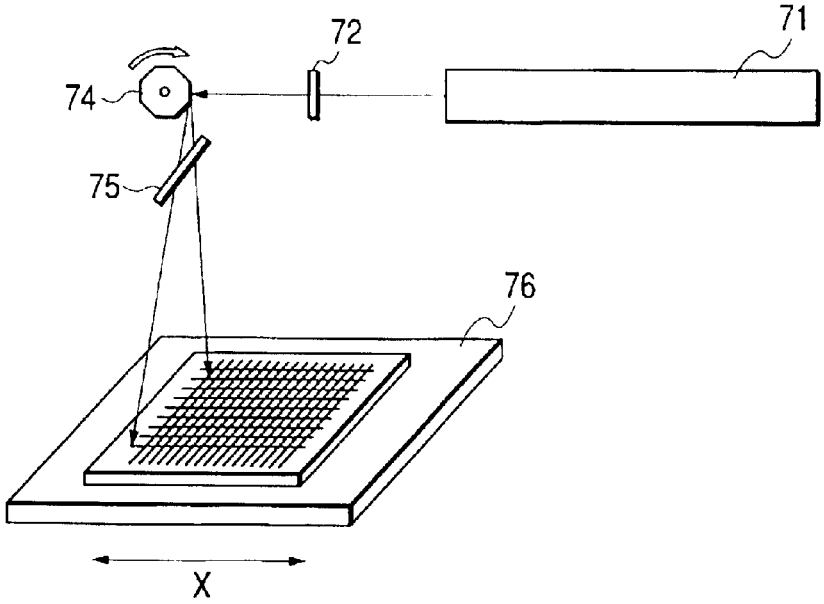
Figure 14:
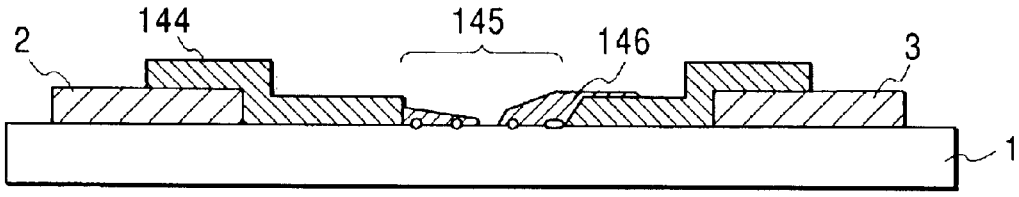
FIG. 14 is a schematic diagram showing an electron-emitting device according to a conventional example.

FIGS. 13A and 13B are schematic diagrams for illustrating irradiation of the polymer films 6 arranged in a matrix on the substrate 1 with the light beam. In FIGS. 13A and 13B, reference numeral 71 denotes a light source. In the case of irradiating with the light beam, the substrate 1 after the step 3 may be irradiated in the atmosphere, inert gas or vacuum. However, it is desirably disposed in an atmosphere in which no oxidation occurs, such as in an inert gas or in a vacuum.

To adjust the light quantity, the power of the light source may be directly adjusted, or an ND filter shown in FIGS. 13A and 13B may be provided to adjust the light quantity.

While the polymer film 6 may be irradiated with the light beam in a direct current manner, it is preferably irradiated with the electron beam in a pulsed manner.

As shown in FIG. 13A, the substrate 1 may be disposed on an XY table 73 which is movable in the x and y directions, and the substrate 1 may be moved in the x and y direction with respect to the light beam to change the relative positions between the substrate 1 and the light beam, thereby irradiating the polymer films 6 arranged in a matrix with the light beam.

Alternatively, an apparatus shown in FIG. 13B may be used. Specifically, as shown in FIG. 13B, means for controlling the travel direction of light, which is composed of a polygon mirror 74, a lens 75 and the like, may be used to move the light beam in the x and y directions, thereby changing the relative position between the substrate 1 and the light beam to irradiate the polymer films 6 arranged in a matrix with the light beam.

Furthermore, the substrate 1 may be disposed on a table 76 which is movable in the x direction, and the polymer films 6 arranged in a matrix may be irradiated with the light beam by moving the substrate 1 in the x direction and, in synchronization therewith, moving the light beam in the y direction. Of course, such relative movements of the energy irradiation source and the substrate 1 can be applied not only to the case of using light for the energy beam but also to the case of using the electron beam and ion beam described above for the energy beam.

(Ion Beam Irradiation)

Figure 15:
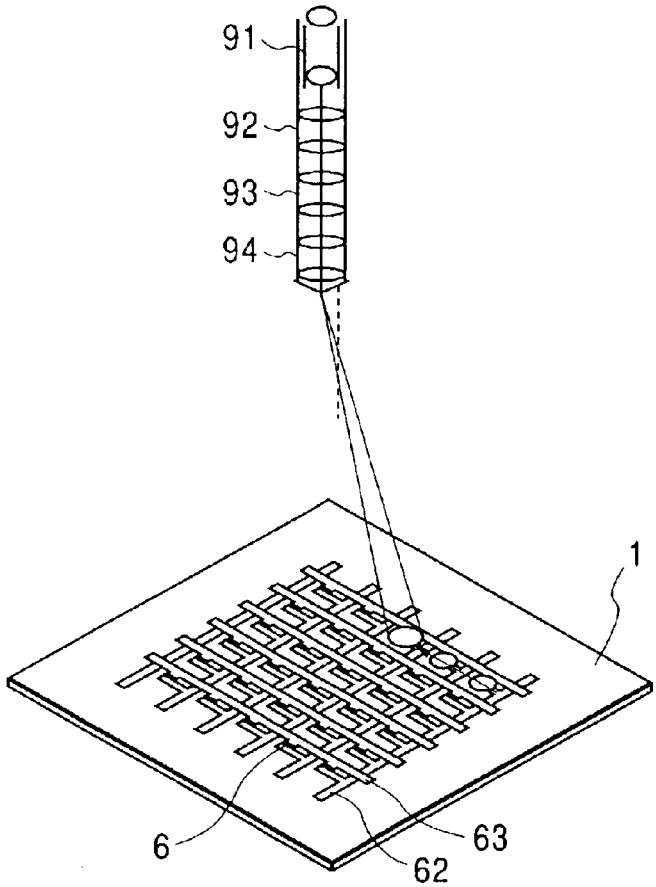
FIG. 15 is a diagram for illustrating a step of reducing a resistance of a polymer film using an ion beam irradiator according to this invention.

FIG. 15 is a schematic diagram for illustrating irradiation of the polymer films 6 arranged in a matrix on the substrate 1 with the ion beam. In FIG. 15, reference numeral 91 denotes ion beam emitting means.

The ion beam emitting means 91 has an ion source of an electron impact type or the like, and an inert gas (desirably Ar) of $1\times10^{-2}$ Pa or lower is flowed thereto.

For accurately scanning with the ion beam, a feature 94 may be additionally provided to converge or deflect the ion beam using an electric field or magnetic field. In addition, ion beam blocking means 93 may be provided to precisely control the ion beam irradiation region.

While the polymer film 6 is preferably irradiated with the ion beam in a pulsed manner, it may be irradiated with the ion beam in a direct current manner.

With such resistance reducing processings, the substrate 1 and other members are not required to have high heat resistance.

In the case where all of the polymer films 6 are irradiated with the energy beam, such as electron beam, light beam and ion beam to reduce the resistance thereof, and then the gaps 5 are formed in the films 6' with the reduced resistance, the time required is increased as the number of the devices (number of the polymer films) is increased.

Besides, for example, if the resistance of all the polymer films 6 in one row (all the polymer films 6 connected to one x-directional wiring 63, for example) is reduced, and then, the gaps are formed in the films 6' with the reduced resistance simultaneously, the current flowing through the x-directional wiring interconnecting the films 6' with the reduced resistance becomes large. At the same time, a voltage drop may occur due to the resistance of the wiring, and thus the current flowing through the films 6' with the reduced resistance may vary from film to film, resulting in variations in the configurations of the gaps formed. Such variations in the configurations are undesirable because they affect the electron-emitting properties of the electron-emitting devices.

Therefore, according to this invention, some (typically one) of the large number of polymer films 6 are/is selected, the resistance of the selected polymer film(s) 6 is reduced, the gap(s) are/is formed in the film(s) 6' with the reduced resistance, other (another) polymer film(s) 6 are/is selected and reduced in resistance, and then the gap(s) are/is formed in the film(s) 6' with the reduced resistance. Such a procedure is performed (repeated) sequentially until all the polymer films 6 are reduced in resistance and the gaps are formed in all the films 6' with the reduced resistance.

In order to reduce the resistance of one or more of the large number of polymer films arranged, the selected polymer film(s) is/are irradiated with the energy beam, such as electron beam, light beam and ion beam, as described above. Using the electron beam, light beam or ion beam enables the resistance of only the selected polymer film(s) 6 to be reduced.

Therefore, while reducing the resistance of one polymer film 6, the gap can be formed in another polymer film 6' having been reduced in resistance. Thus, compared to the method of reducing the resistance of all the polymer films before forming the gaps in the films 6' with the reduced resistance, the power required can be distributed in terms of time. Thus, an electron source and image-forming apparatus having a large area can be provided in a short time, and an electron source having an excellent electron-emitting property and high uniformity and an image display apparatus including the electron source can be provided.

Now, one example of the step 4 involving the electron beam will be described with reference to FIGS. 1, 2A through 2B, 3, 12, 21 and the like.

First, the substrate 1 after the step 3 (see FIG. 10) and the electron-emitting means 81 are disposed in the apparatus with the internal pressure being reduced (see FIG. 12).

Figure 1:
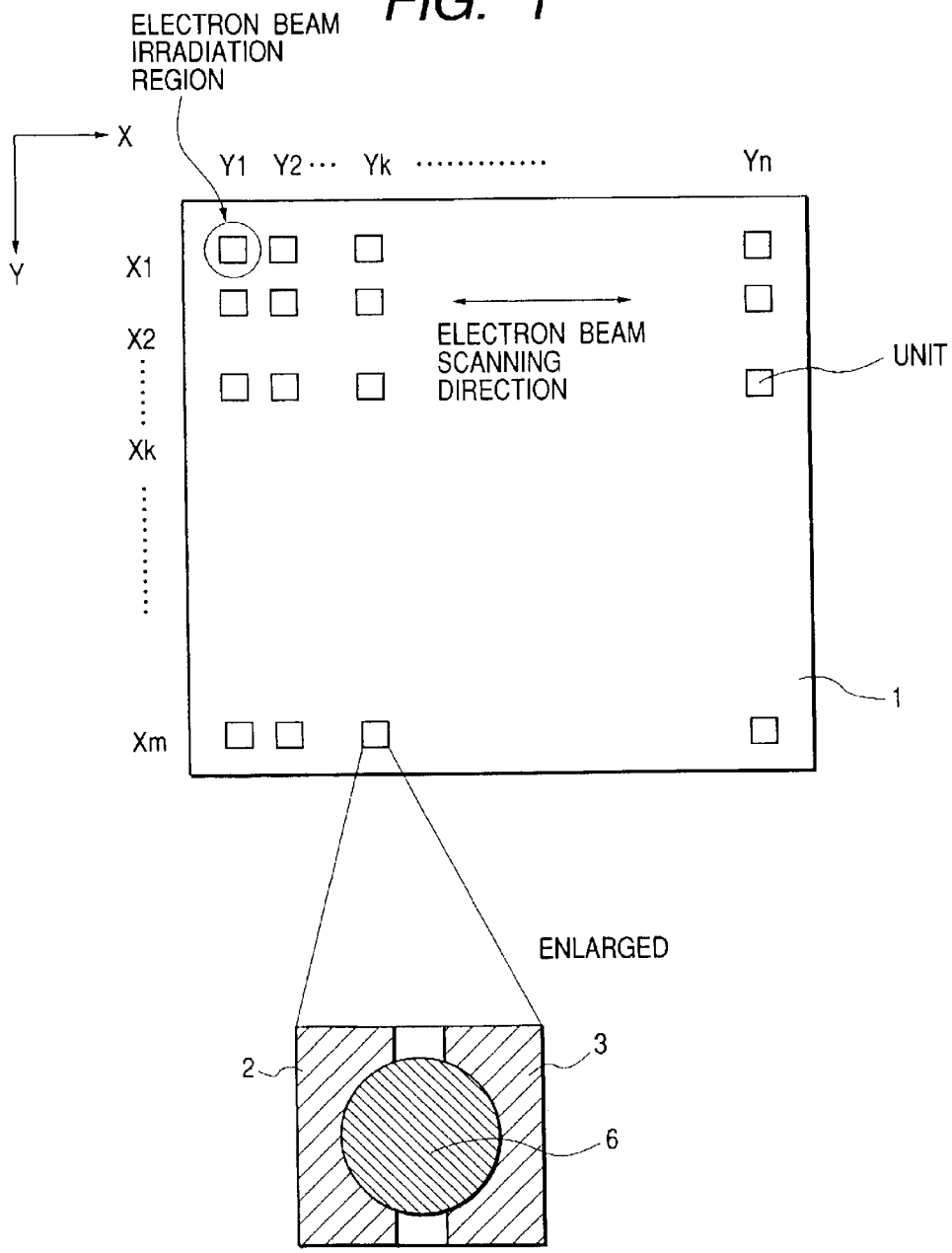
FIG. 1 is a diagram for illustrating energy irradiation, such as electron beam irradiation, according to this invention.

Then, irradiation with the electron beam is performed. For the irradiation with the electron beam, as shown in FIG. 1, scanning with the electron beam is performed at a predetermined frequency from Y1 to Yn in the direction parallel to the x-directional wirings 63 (X1 to Xm), and simultaneously, the electron beam irradiation region is moved from X1 to Xn in the direction of the y-directional wirings 62 at an optimum speed. In the shown example, one polymer film is irradiated with the electron beam. However, by adjusting the diameter of the electron beam spot, a plurality of polymer films (a plurality of units) lying within a range defined by coordinates (X(i), Y(i)) and (X(i+k), Y(i+k)) can be irradiated simultaneously. The frequency of the scanning in the direction of the x-directional wirings may assume a value from 0.1 Hz to 1 MHz. However, it is preferably about 0.1 Hz to 100 Hz. The speed of moving the electron beam irradiation region in the direction of the y-directional wirings depends on an optimal irradiation time, which is determined by the thickness of the polymer film 6, thermal conductivities of the substrate 1 and electrodes 2, 3 and the like.

Figure 16A:
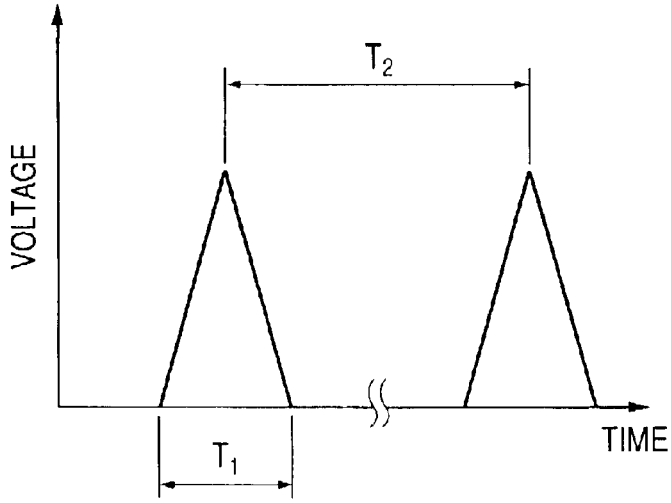
FIGS. 16A and 16B are graphs showing one example of a voltage waveform for providing a gap in the transformed film according to this invention.
Figure 16B:
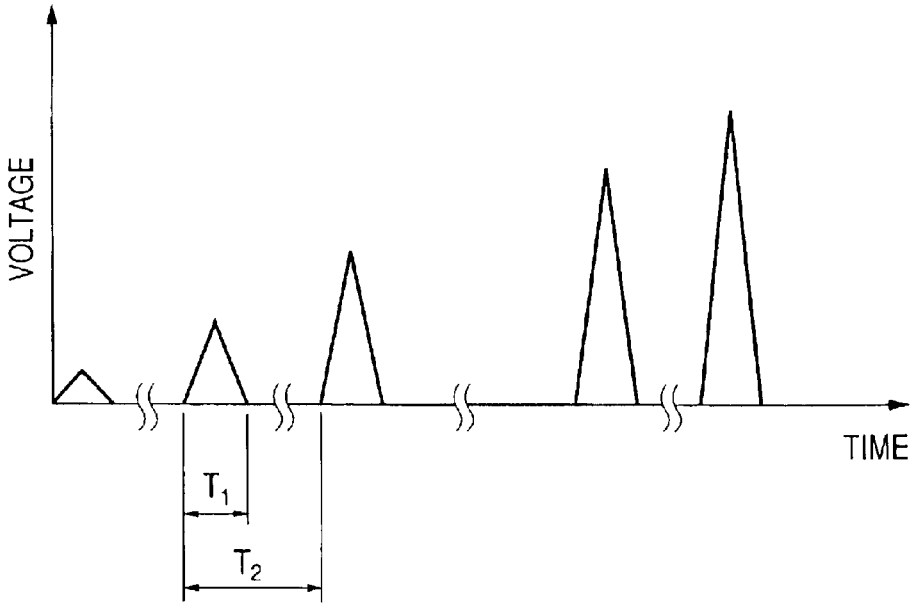

To the devices (films 6' with the reduced resistance) in the row X(k), which have been irradiated with the electron beam for a predetermined time, a voltage is applied to form the gaps therein. The voltage applied to the units (films 6' with the reduced resistance) for forming the gaps therein is preferably pulsed. The pulse may be a triangular pulse with a constant pulse height as shown in FIG. 16A, or a triangular pulse with a gradually increasing pulse height as shown in FIG. 16B. Besides the triangular pulse, a rectangular pulse may be used. When a voltage is applied across the device electrodes 2 and 3 from a power supply (not shown) through the x-directional wiring and/or y-directional wiring, a current flows through the film 6' with the reduced resistance to produce a Joule heat, which allows the gap 5 to be formed in the film 6' with the reduced resistance. Thus, in this step, the electron-emitting device comprising the carbon film with the gap is provided.

Figure 2A:
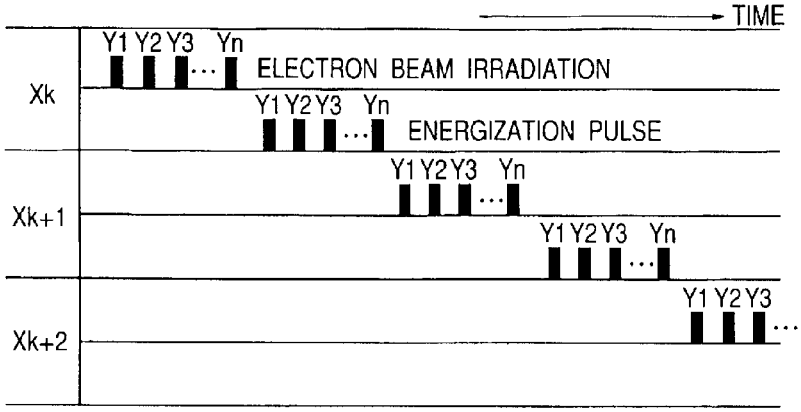
FIGS. 2A and 2B illustrate timings of energy irradiation, such as electron beam irradiation, and voltage application according to this invention.
Figure 2B:
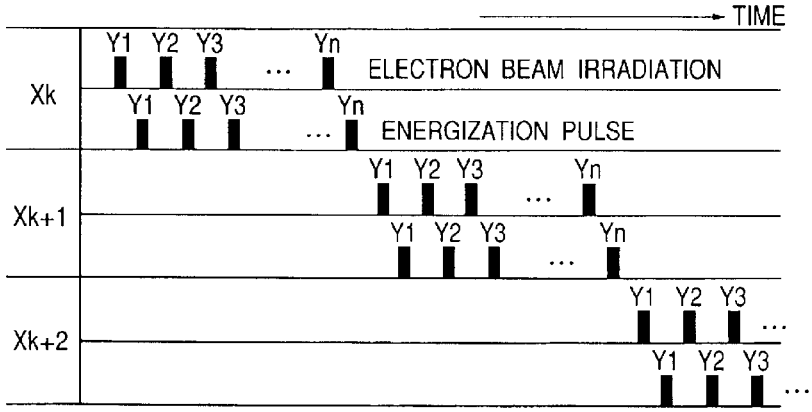

FIGS. 2A and 2B illustrate timings of electron beam irradiation and voltage application according to this invention. This invention is not limited thereto, and it is essential that the step of reducing the resistance of the polymer film and then forming the gap in the film with the reduced resistance is repeated. Here, upper series of solidly shaded pulses for respective rows X(k), X(k+1), and X(k+2) in FIGS. 2A and 2B represent the timings of irradiating the selected polymer films (polymer films which have not been processed with the resistance-reducing step) with the electron beam, and lower series of solidly shaded pulses for respective rows X(k), X(k+1), and X(k+2) in FIGS. 2A and 2B represent the timings of applying the pulsed voltage to the selected films 6' (films obtained by the resistance-reducing step). In the shown example, one polymer film 6 is irradiated with one pulse of electron beam and one film 6' is applied with one pulse of pulsed voltage. Here, an example of applying the pulse voltage to the same film 6' only one time was shown, but the pulse voltage is preferably applied to the same film 6' repeatedly. For simplifying the description, FIGS. 2A and 2B show cases where the electron beam irradiation and voltage application are preformed on each of three sets of a plurality of polymer films connected to their respective x-directional wirings (X(k), X(k+1), and X(k+2)). When applied to the image display apparatus, several hundreds to several thousands of x-directional wirings are used. In the example shown here, the electron beam irradiation is sequentially performed on the polymer films in a direction parallel to the longitudinal direction of the x-directional wiring. Furthermore, in the example described here, one x-directional wirings is selected among from a large number of x-directional wirings, and a plurality of polymer films commonly connected to the selected x-directional wiring are sequentially irradiated with the electron beam. Then, another x-directional wiring is selected, and a plurality of polymer films commonly connected to the selected another x-directional wiring are sequentially irradiated with the electron beam. Such a process is repeatedly performed. In the example shown in FIG. 2A, after the electron beam irradiation (resistance reducing processing) of the plurality of polymer films 6 commonly connected to the selected one x-directional wiring is completed as described above, the voltage pulses are sequentially applied to the films 6' having been irradiated with the electron beam (films 6' processed by the resistance-reducing step). In the example shown in FIG. 2B, immediately after the electron beam irradiation (resistance reducing processing) of one polymer film 6 is completed, the voltage pulse is applied to the film 6' obtained by the resistance reducing processing. While the case of using the electron beam irradiation in the resistance reducing processing for the polymer film 6 has been described, the scheme shown in FIGS. 2A and 2B and the like can be applied to the case where the laser irradiation, light irradiation, or ion beam irradiation is used.

Figure 21:
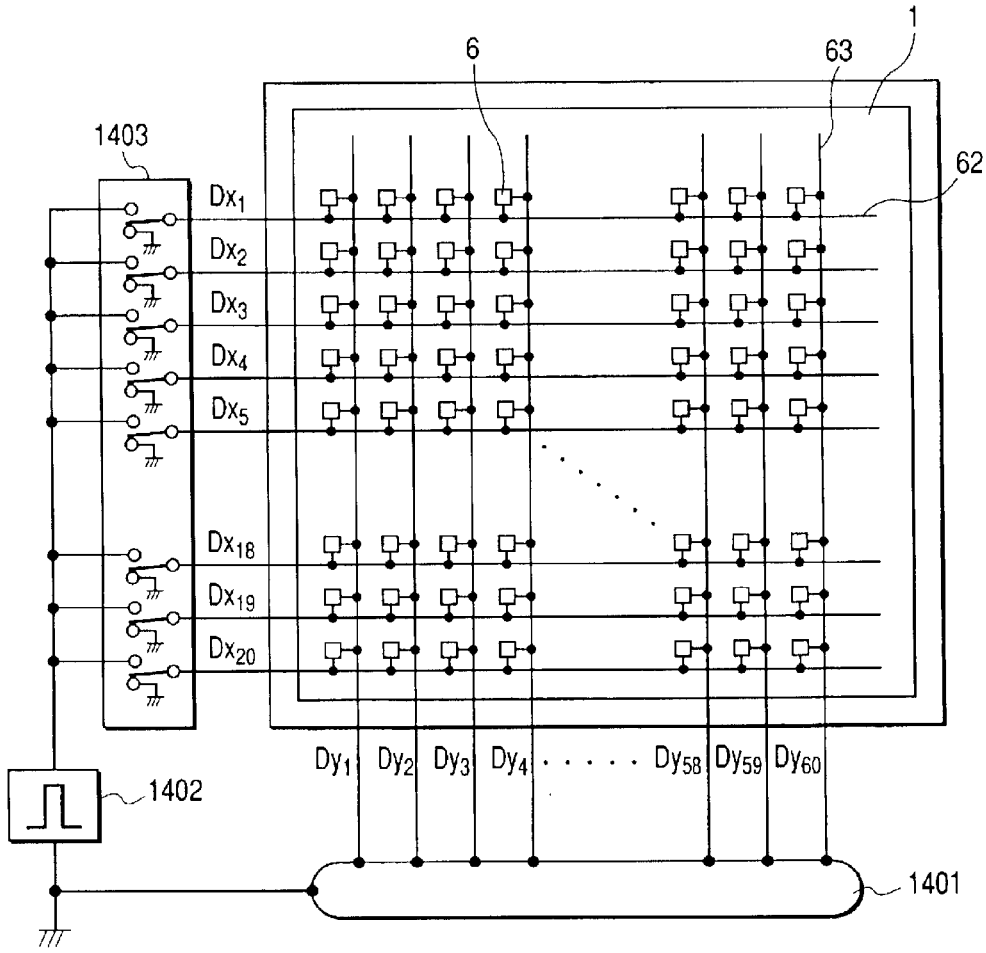
FIG. 21 is a diagram for illustrating a process for forming the gap in the polymer having the resistance reduced.

One example of the circuit configuration for applying the pulsed voltage is schematically shown in FIG. 21. The y-directional wirings 62 are connected to a common electrode 1401 by connecting external terminals Dy1 to Dyn thereto and then connected to a grounding terminal of a pulse generator 1402. The x-directional wirings 63 are connected to a control switching circuit 1403 via external terminals Dx1 to Dxm (in this drawing, m=20 and n=60). The control switching circuit 1403 serves to connect each of the terminals to the pulse generator 1402 or ground, and the function thereof is schematically shown in this drawing. The switching circuit 1403 enables one of the x-directional wirings to be arbitrarily selected. The pulse width, frequency and pulse height of the voltage pulse are appropriately set to provide a voltage not causing destruction of the film 6' obtained by the resistance reducing processing but being enough to form the gap in the film 6'.

In the case of the triangular pulse, the pulse width of the applied pulse is set at 1 $\mu$s to 10 ms, and the pulse interval thereof is set at 10 $\mu$s to 100 ms, for example. The end of the voltage application to the film 6' obtained by the resistance reducing procesing can be determined by applying a low voltage pulse not causing destruction or the like of the film 6' during the period between the pulses and detecting the current flowing between the electrodes 2 and 3. For example, it is preferred that a voltage on the order of 0.1 V is applied between the electrodes 2 and 3, the current flowing therebetween is measured to determine the resistance value, and then, when the resistance value becomes higher than 1 MΩ, the voltage application to the film 6' obtained by the resistance reducing processing is stopped.

Figure 3:
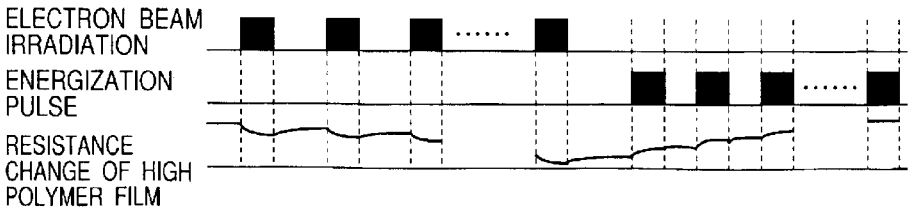
FIG. 3 illustrates a resistance change of a polymer film with respect to the timings of energy irradiation, such as electron beam irradiation, and voltage application.

FIG. 3 schematically illustrates a resistance change of the polymer film 6 in the case where the gap is formed in one device by applying the electron beam irradiation and energization pulse thereto a plurality of number of times. When the polymer film is irradiated with the electron beam, the resistance thereof is reduced. Then, if the pulse voltage is applied to the film 6' after the resistance thereof is reduced sufficiently, during the voltage application, the resistance of the film gradually increases because of the gap generation. Then, when the pulsed voltage is applied to the film 6' sufficiently, the film 6' has a sufficiently high resistance (the "gap forming process" is completed).

Now, one example of an image display apparatus including the electron source of the matrix arrangement will be described with reference to FIG. 17 and FIGS. 18A through 18B. Here, FIG. 17 shows a basic configuration of a display panel 201, and FIGS. 18A and 18B show phosphor films 114.

Figure 17:
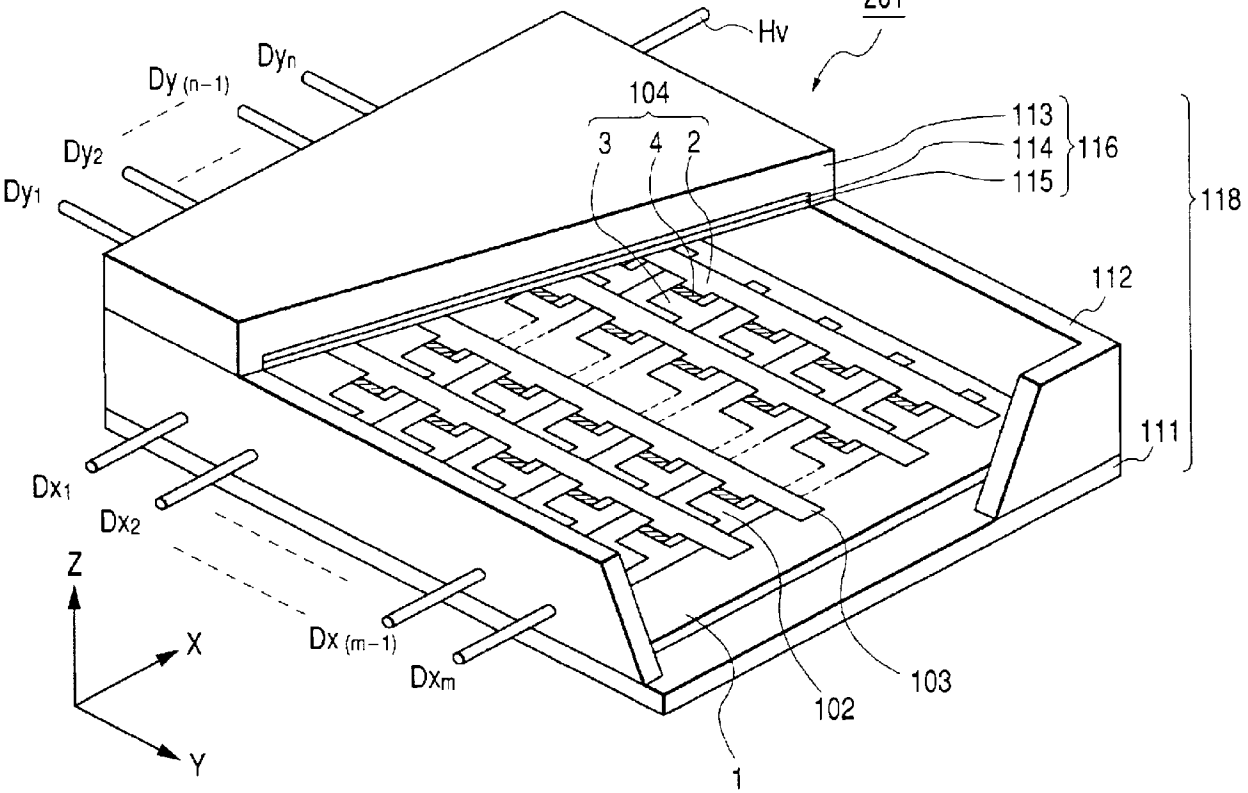
FIG. 17 is a partially cut away perspective view schematically showing a display panel having the electron source of a simple matrix arrangement.
Figure 18A:
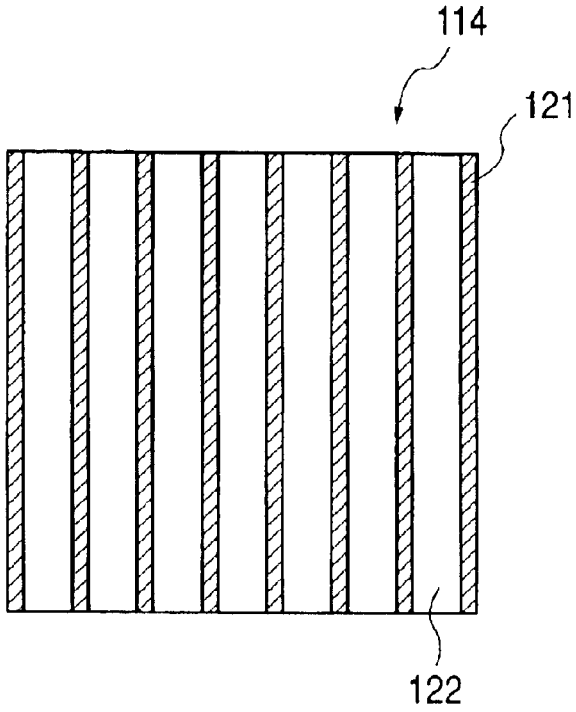
FIGS. 18A and 18B show examples of a configuration of a phosphor film used in the display panel.
Figure 18B:
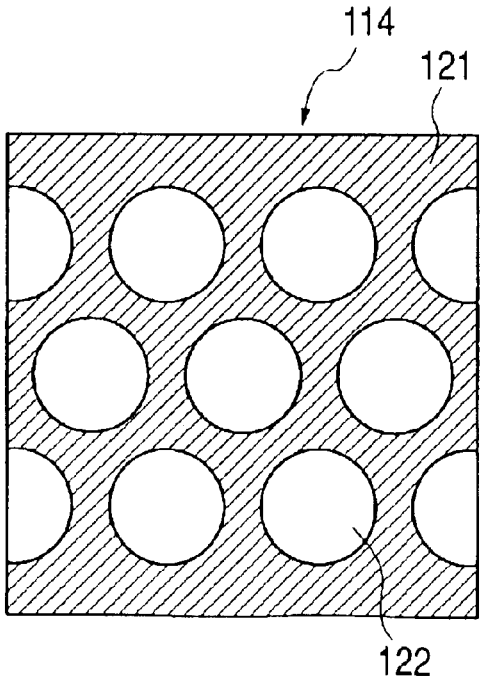

In FIG. 17, reference numeral 1 denotes a substrate having the electron source fabricated as described above, reference numeral 111 denotes a rear plate to which the substrate 1 is fixed, reference numeral 116 denotes a face plate including a glass substrate 113, the phosphor film 114, a metal back (electroconductive film) 115 and the like, the phosphor film 114 and the metal back 115, which are image-forming members, being formed on the inside surface of the glass substrate 113, and reference numeral 112 denotes a support frame. Reference numerals 102 and 103 denote an x-directional wiring and a y-directional wiring connected to a pair of device electrodes 2, 3 of an electron-emitting device 104, respectively. The x-directional wiring and the y-directional wiring have external terminals Dx1 to Dxm and Dy1 to Dyn, respectively.

The rear plate 111, the support frame 112 and the face plate 116 are seal-bonded to each other to constitute an envelope 118 by applying a bond, such as a frit glass, to connections thereof and firing the assembly at a temperature from 400 to 500 degrees Celsius for 10 or more minutes in the atmosphere or a nitrogen atmosphere, for example. The rear plate 111 is mainly intended to reinforce the substrate 1. If the substrate 1 has a sufficient strength in itself, the separate rear plate 111 is not needed, and the support frame 112 may be directly seal-bonded to the substrate 1, so that the face plate 116, the support frame 112 and the substrate 1 constitute the envelope 118. A support member (not shown), referred to as a spacer, may be additionally provided between the face plate 116 and the rear plate 111, thereby forming the envelope 118 having a sufficient strength against the atmospheric pressure.

In the case of monochrome display, the phosphor film 114 is composed of only a phosphor 122. In the case of color display, the phosphor film 114 is composed of a phosphor 122 and a light-absorbing body 121 of a black color or the like, which is referred to as a black stripes (FIG. 18A) or black matrix (FIG. 18B) depending on the arrangement of the phosphors 122. The black stripes or black matrix are/is provided to make color mixing or the like inconspicuous by blacking the separations between the phosphors 122 for the three primary colors required for color display, and to suppress a reduction in contrast due to external light reflection by the phosphor film 114. The material of the light-absorbing body 121 is not limited to those mainly composed of graphite, which are typically used, and may be any other material as far as it has an adequate conductivity, a low transmittance and reflectivity.

In order to apply the phosphor 122 onto the glass substrate 113, a precipitation method or printing method may be used regardless of the monochrome display or color display.

As shown in FIG. 17, the conductive film 115, which is typically referred to as a metal back, is provided on the inside surface of the phosphor film 114. The metal back 115 is intended to enhance the brightness by mirror-reflecting the light emitted toward the inside from the phosphor 122 (see FIGS. 18A and 18B) back toward the face plate 116, to serve as an electrode for applying an electron beam acceleration voltage from a high voltage terminal Hv, and to protect the phosphor 122 against a damage due to an impact of a negative ion generated in the envelope 118, for example. The metal back 115 may be formed by, after the phosphor film 114 is formed, performing a smoothing processing (typically referred to as filming) on the inside surface of the phosphor 114 and then depositing Al thereon by vacuum evaporation or the like.

The envelope 118 is sealed with the interior being exhausted to a degree of vacuum of $10^{-4}$ to $10^{-8}$ Pa via an exhaust pipe (not shown), for example. Alternatively, the envelope 118 may be formed without the exhaust pipe by performing seal bonding in a vacuum.

The image display apparatus according to this invention having the display panel 201 and the drive circuit described above applies a voltage through the external terminals Dx1 to Dxm and Dy1 to Dyn to cause an arbitrary electron-emitting device 104 to emit electrons, applies a high voltage to the metal back 115 or a transparent electrode (not shown) through the high voltage terminal Hv to accelerate the electron beam and makes the accelerated electron beam impact onto the phosphor film 114 to cause pumping and light emission, thereby providing a television display in response to a television signal.

In the example described above, the electron-emitting devices are arranged in a matrix. However, besides the matrix arrangement, the electron-emitting devices in the electron source according to this invention may be arranged in a ladder-like arrangement, in which, as shown in FIG. 19, a plurality of rows of the electron-emitting devices 104 arranged side by side are arranged in parallel, and the terminals (device electrodes) of the devices on opposite sides thereof are interconnected by the respective wirings 304.

One example of the electron source of the ladder-like arrangement and the image display apparatus including the same according to this invention will be described with reference to FIGS. 19 and 20.

Figure 19:
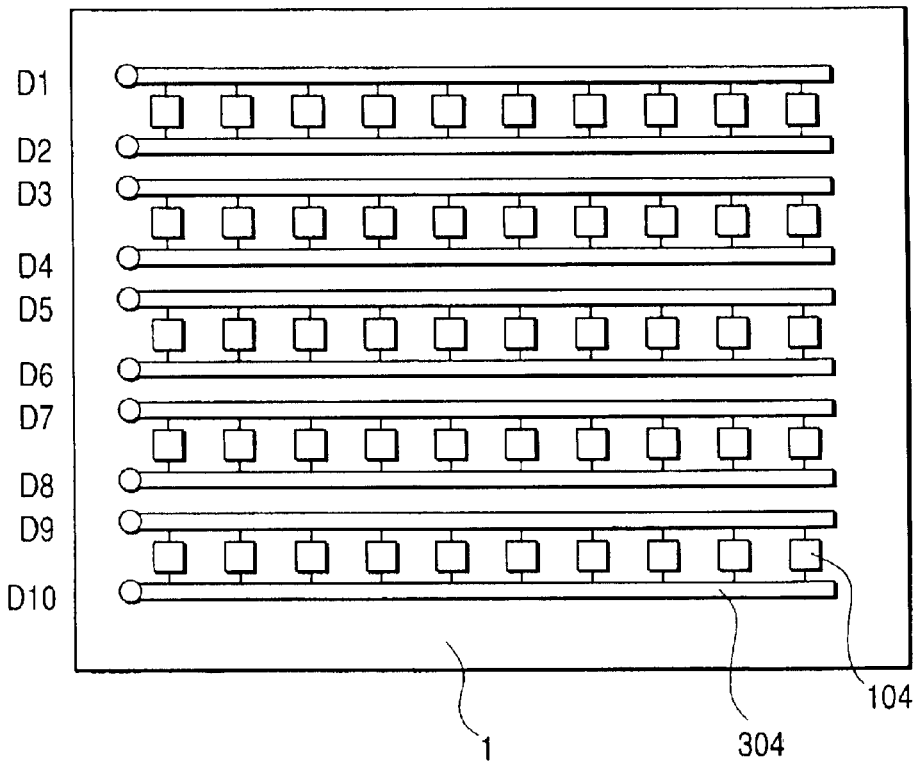
FIG. 19 is a schematic view of the electron source of a ladder-like arrangement.

In FIG. 19, reference numeral 1 denotes a substrate, reference numeral 104 denotes an electron-emitting device, and reference numeral 304 denotes a common wiring for interconnecting the electron-emitting devices 104. There are provided ten common wirings each having external terminals D1 to D10.

A plurality of electron-emitting device 104 are arranged side by side on the substrate 1. This arrangement is referred to as a device row. A plurality of device rows are disposed to constitute the electron source. Each device row can be driven independently by applying an appropriate drive voltage between the common wirings 304 of the device row (for example, the common wirings 304 connected to the external terminals D1 and D2). That is, a voltage higher than a threshold voltage may be applied to the device row intended for emitting the electron beam, and a voltage equal to or lower than the threshold voltage may be applied to the device row not intended for emitting the electron beam. Such drive voltage application can be accomplished if adjacent two wirings 304 of the common wirings D2 to D9 located between the device rows, that is, the common wirings connected to the external terminals D2 and D3, D4 and D5, D6 and D7, and D8 and D9 may be each integrated into one wiring.

Figure 20:
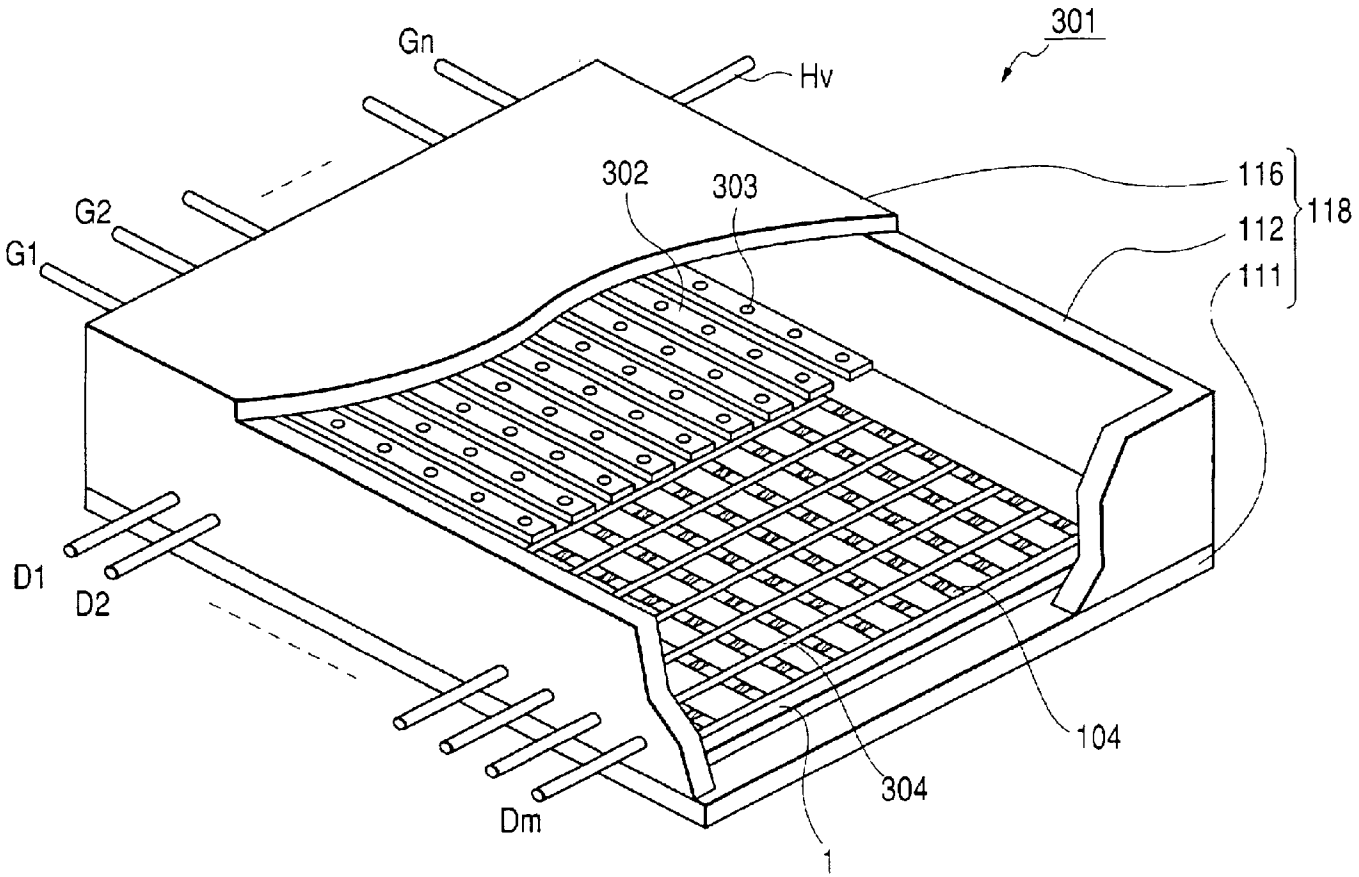
FIG. 20 is a partially cut away perspective view schematically showing the display panel having the electron source of the ladder-like arrangement.

FIG. 20 shows a display panel 301 having the electron source of the ladder-like arrangement. In FIG. 20, reference numeral 302 denotes a grid electrode, reference numeral 303 denotes an opening for electrons to pass through, reference numerals D1 to Dm denote external terminals for applying a voltage to the electron-emitting devices, and reference numerals G1 to Gn denote terminals connected to the respective grid electrodes 302. The common wirings 304 are formed on the substrate 1 by integrating the common wirings between the device rows into one wiring.

In FIG. 20, the same reference numerals as in FIG. 17 denote the same members as in FIG. 17. The significant difference from the display panel 201 including the electron source of the passive matrix arrangement is that the grid electrodes are provided between the substrate 1 and the face plate 116.

As described above, the grid electrodes 302 are provided between the substrate 1 and the face plate 116. The grid electrode 302 can modulate the electron beam emitted from the electron-emitting device 104. The grid electrode 302 is an electrode stripe that is perpendicular to the device rows arranged in a ladder shape and has circular openings 303 formed therein one for each of the electron-emitting devices 104 to pass the electron beam therethrough.

The shape and position of the grid electrode are not necessarily limited to those shown in FIG. 20. A large number of meshed openings 303 may be provided, and the grid electrodes 302 may be positioned around or in the vicinity of the electron-emitting device 104, for example.

The external terminals D1 to Dm and G1 to Gn are connected to a drive circuit (not shown). In synchronization with sequentially driving (scanning) the device rows one by one, a modulation signal for one line of image is applied to columns of the grid electrodes 302. In this way, irradiation of the phosphor film 114 with each electron beam can be controlled, and the image can be displayed on a line-by-line basis.

EXAMPLES

Now, this invention will be described with reference to examples. However, this invention is not limited to these examples and includes various replacements of elements or modifications in design within a scope in which objects of this invention can be attained.

Example 1

This example relates to the method for manufacturing the electron source by disposing a large number of electron-emitting devices on the substrate and interconnecting the devices by matrix wiring.

First, the method for manufacturing the electron source in this example will be described specifically with reference to FIGS. 5 to 11 and the like.

Step-a

The pairs of device electrodes 2 and 3 were formed (300 in the x direction and 100 in the y direction) by photolithography on the high-strain-point glass substrate 1 (manufactured by Asahi Glass Co., Ltd., PD 200, softening point 830 degrees Celsius, annealing point 620 degrees Celsius, and strain point 570 degrees Celsius) (FIG. 5).

Step-b

Then, 300 y-directional wirings 62 mainly composed of Ag were formed by screen printing method (FIG. 6).

Step-c

Then, the interlayer insulating layers 64 mainly composed of $SiO_2$ were formed by screen printing method (FIG. 7).

Step-d

Then, 100 x-directional wirings 63 mainly composed of Ag were formed by screen printing method (FIG. 8).

Step-e

After the steps a to d is performed, the solution of polyamic acid, which is a precursor of polyimide, in 3% N-methylpyrrolidone/triethanolamine is applied between the respective device electrode pairs by inkjet method so that the respective electrode pairs may be connected via the solution. Then, baking the substrate 1 was performed in a vacuum condition at 350 degrees Celsius to form the circular polymer films 6 made of polyimide and having a diameter of 100 $\mu$m and a thickness of 300 nm (FIG. 9).

By the steps, the electron source substrate before the gaps being formed comprising the insulating substrate 1 and the plurality of polymer films 6 matrix-wired thereon by the x-directional wirings 63 and the y-directional wirings 62 was provided.

Then, as shown in FIG. 12, the electron source substrate fabricated as described above was placed to face the electron beam irradiation means (81 to 84). Then, the polymer films 6 were subjected to the resistance reducing processing, and the resulting films 6' with the reduced resistance were subjected to the gap forming processing.

Specifically, the substrate 1 fabricated through the steps a to e was placed in a vacuum container having the electron beam irradiation means placed therein, and the inside of the vacuum container was exhausted by a vacuum pump via an exhaust pipe (not shown) to a pressure of $1\times10^{-3}$ Pa or lower.

Then, under the conditions that the potential difference between the electron beam source and the substrate 1 was set at 8 kV, and the irradiation area of the electron beam was set as 30 $mm^2$ (radius being about 3 mm), the electron beam was applied through a slit.

The electron beam irradiation was performed on all devices (all polymer films) by scanning in the direction of the x-directional wiring at a frequency of 60 Hz to irradiate the polymer films Y1 to Yn with the electron beam. The electron beam irradiation was performed in a vacuum at 25 degrees Celsius. The start point of the electron beam irradiation was appropriately set so that all the devices are irradiated with the electron beam of the same intensity for the same time.

The pulsed voltage application to the devices was performed using the wiring circuit shown in FIG. 21. The switching circuit 1403 enabled any device row extending in the x direction to be selected, and the pulse height of the voltage pulse was set at 10 V.

In this example, the electron beam irradiation and the voltage application were performed according to the timings shown in FIG. 2A. Here, the diagonally shaded pulses in FIG. 2A represent the timings of irradiating the selected polymer films with the electron beam.

As described above, the polymer film 6 was irradiated with the electron beam to provide the film 6' with the reduced resistance (FIG. 10), and then, the gap 5 was formed in the film 6' with the reduced resistance by applying a voltage thereto (FIG. 11).

Then, the image display apparatus including the electron source substrate 1 fabricated as described above was fabricated. The fabrication procedure therefor will be described below with reference to FIG. 17.

First, the electron source substrate 1 was fixed onto the rear plate 111. Then, the face plate 116 was disposed 5 mm above the substrate 1 with the support frame 112 interposed therebetween, the face plate 116 being composed of the glass substrate 113 and the image-forming members including the phosphor film 114 and the metal back 115 formed on the inside surface of the glass substrate 113. Frit glass was applied to the connections of the face plate 116, support frame 112 and rear plate 111, and the assembly was fired for 10 minutes in the atmosphere at 400 degrees Celsius for seal bonding. Here, the substrate 1 was also fixed to the rear plate 111 with frit glass.

For the phosphor film 114, which is an image-forming member, a stripe-like phosphor (see FIG. 18A) was used to realize color display. It was fabricated by first forming the black stripes 121 and then applying the phosphors 122 to the regions between the stripes using slurry. The material of the black stripes 121 was a material mainly composed of graphite, which is typically used. In addition, the metal back 115 was provided on the inside surface of the phosphor film 114. The metal back 115 was formed by, after the phosphor film 114 was formed, performing the smoothing processing (typically referred to as filming) on the inside surface of the phosphor 114 and then depositing Al thereon by vacuum deposition.

The vacuum container (envelope 118) formed as described above was exhausted by a vacuum pump via an exhaust pipe (not shown) while being heated. Then, the internal pressure of the vacuum container became equal to or lower than $1.3\times10^{-6}$ Pa, the exhaust pipe (not shown) was heated by a gas burner to be welded to seal the vacuum container. In addition, to maintain the low internal pressure of the vacuum container, the getter processing was performed by high-frequency heating.

The image display apparatus fabricated as described above was passive-matrix driven to cause the electron-emitting devices to sequentially emit electrons, and the device current If and the emission current Ie were measured for each device. The electron emission efficiency, which is defined by a formula Ie/If, was 210% of that of a conventional device and the emission current Ie was 150% of that of the conventional device in terms of mean value. The variation of the emission current value Ie among the devices was quite small.

Furthermore, the displayed image on the image display apparatus had high brightness and uniformity and was stable for a long time.

Example 2

In this example, the electron source substrate having the polymer films 6 formed thereon fabricated by the steps a to e in the example 1 was placed in the light beam irradiating apparatus as shown in FIG. 13A to subject the polymer films 6 to the resistance reducing processing. The electron source substrate was fabricated in the same manner as in the example 1 except that the light beam was used. Thus, the description thereof will be omitted.

As the light source 71, the Nd:YAG second harmonic laser light source ($\lambda$=532 nm) was used. Under the conditions that the power of the light source 71 was set at 5.6 W and a 40% transmittance filter was used as an ND filter 72, the polymer films 6 were irradiated. The laser irradiation was performed in a vacuum at 25 degrees Celsius.

The timings of the laser irradiation and voltage application in this example were the same as those shown in FIG. 2B. Here, the diagonally shaded pulses in FIG. 2B represent the timings of irradiating the selected polymer films with the laser beam.

By these steps, the gaps were formed in the films 6' obtained by subjecting all the polymer films 6 to the resistance reducing processing to provide the electron source.

Then, the image display apparatus including the electron source substrate fabricated as described above was fabricated as in the example 1. And, the image display apparatus was passive-matrix driven to cause the electron-emitting devices to sequentially emit electrons, and the device current If and the emission current Ie were measured for each device. The electron emission efficiency, which is defined by the formula Ie/If, was 190% of that of a conventional device and the emission current Ie was 145% of that of the conventional device in terms of mean value. The variation of the emission current value Ie among the devices was quite small.

As in the case of the image display apparatus fabricated in the example 1, the displayed image on the image display apparatus fabricated in this example had high brightness and uniformity and was stable for a long time.

Example 3

In this example, the electron source substrate having the polymer films 6 formed thereon fabricated by the steps a to e in the example 1 was placed in the ion beam irradiating apparatus as shown in FIG. 15 to subject the polymer films 6 to the resistance reducing processing. The electron source substrate was fabricated in the same manner as in the example 1 except that the ion beam was used. Thus, the description thereof will be omitted.

In the ion beam irradiating apparatus, an ion source of the electron impact type was used, and an inert gas (desirably Ar) of $1\times10^{-3}$ Pa was flowed thereto. Under the conditions of the acceleration voltage of 5 kV, and the irradiation area of 2 $mm^2$ (radius being about 0.8 mm).

The ion beam irradiation was performed by scanning in the direction of the x-directional wiring at a frequency of 1 Hz so as to apply the ion beam to the centers of slits and moving the irradiation ion beam in the direction of the y-directional wiring from Y1 to Yn. The ion beam irradiation was performed in a vacuum at 25 degrees Celsius.

The timings of the ion beam irradiation and voltage application in this example were the same as those shown in FIG. 2A. Here, the diagonally shaded pulses in FIG. 2A represent the timings of irradiating the selected polymer films with the ion beam.

Then, the image display apparatus including the electron source substrate fabricated as described above was fabricated as in the example 1. And, the image display apparatus was passive-matrix driven to cause the electron-emitting devices to sequentially emit electrons, and the device current If and the emission current Ie were measured for each device. The electron emission efficiency, which is defined by the formula Ie/If, was 185% of that of a conventional device and the emission current Ie was 143% of that of the conventional device in terms of mean value. The variation of the emission current value Ie among the devices was quite small.

As in the case of the image display apparatus fabricated in the example 1, the displayed image on the image display apparatus fabricated in this example had high brightness and uniformity and was stable for a long time.

As described above, according to this invention, in the electron source having a large number of electron-emitting devices arranged therein for emitting electrons in response to an input signal, the electron-emitting devices with excellent electron-emitting property can be arranged on the substrate. Thus, the image-forming apparatus capable of displaying an image with high brightness and uniformity can be enhanced in terms of screen size and production scale.

What is claimed is:

1. A method for manufacturing an electron source, comprising:

(A) a step of disposing a plurality of units and a plurality of wirings connected to the plurality of units on a substrate, each unit comprising a polymer film and a pair of electrodes with the polymer film interposed therebetween; and (B) a step of forming electron-emitting devices from said plurality of units by repeatedly performing a process including a selecting substep of selecting a desired number of units from said plurality of units, a resistance-reducing substep of reducing resistance of the polymer films of the selected units and a gap-forming substep of forming a gap in each of the films obtained by the resistance-reducing substep.

2. The method for manufacturing an electron source according to claim 1, wherein the number of said units selected at one time is two or more.

3. The method for manufacturing an electron source according to claim 1, wherein the gap is formed by passing a current through said film obtained by the resistance-reducing substep.

4. The method for manufacturing an electron source according to claim 1, wherein said plurality of wirings comprises a plurality of row-directional wirings and a plurality of column-directional wirings crossing the row-directional wirings with an insulating layer interposed therebetween, and each of said plurality of units is connected to one of said plurality of row-directional wirings and one of said plurality of column-directional wirings.

5. The method for manufacturing an electron source according to claim 4, wherein said selected units are a plurality of units connected to a same row-directional wiring or same column-directional wiring.

6. The method for manufacturing an electron source according to claim 1, wherein the resistance of said polymer film is reduced by irradiating said polymer film with an energy beam.

7. The method for manufacturing an electron source according to claim 6, wherein said energy beam is emitted from a plurality of energy beam irradiation source.

8. The method for manufacturing an electron source according to claim 6, wherein said energy beam is an electron beam.

9. The method for manufacturing an electron source according to claim 6, wherein said energy beam is a light beam.

10. The method for manufacturing an electron source according to claim 6, wherein said energy beam is a laser beam.

11. The method for manufacturing an electron source according to claim 6, wherein said energy beam is an ion beam.

12. A method for manufacturing a display apparatus having an electron source comprising a plurality of electron-emitting devices and a light emitting member that emits light in response to being irradiated with an electron emitted from said electron source, wherein said electron source is manufactured by the method according to any one of claims 1 to 11.

* * * * *

UNITED STATES PATENT AND TRADEMARK OFFICE

CERTIFICATE OF CORRECTION

PATENT NO. : 6,835,110 B2
APPLICATION NO. : 10/212758
DATED : December 28, 2004
INVENTOR(S) : Hironobu Mizuno et al.

It is certified that error appears in the above-identified patent and that said Letters Patent is hereby corrected as shown below:

ON THE TITLE PAGE [*]:

Notice, "123 days" should read --243 days--.

ON THE TITLE PAGE ITEM [30]:

Foreign Application Priority Data, "2001/241972" should read --2001-241972-- and "2002/217791" should read --2001-217791--.

COLUMN 1:

Line 47, "in-between" should read --in between--; and
Line 54, "better" should read --a better--.

COLUMN 2:

Line 15, "excellent" should read --an excellent--; and
Line 53, "source" should read --sources--.

COLUMN 4:

Line 4, "diagram" should read --diagrams--;
Line 43, "including" should be deleted;
Line 44, "refers" should read --refer--;
Line 45, "bond" should read --a bond--;
Line 51, "photon," should read --photon-- and "heat" should read --heat,--; and
Line 52, "the" should read --a--.

COLUMN 5:

Line 3, "like, a" should read --like. A--;
Line 25, "(ITO") should read --(ITO),--; and
Line 50, "far" should read --long--.

COLUMN 6:

Line 28, "be dissolved" should read --dissolve--; and
Line 48, "gaps" should read --gap--.

UNITED STATES PATENT AND TRADEMARK OFFICE

CERTIFICATE OF CORRECTION

PATENT NO. : 6,835,110 B2
APPLICATION NO. : 10/212758
DATED : December 28, 2004
INVENTOR(S) : Hironobu Mizuno et al.

It is certified that error appears in the above-identified patent and that said Letters Patent is hereby corrected as shown below:

COLUMN 10:

Line 55, “wirings” should read --wiring--.

COLUMN 11:

Line 1, “having” should read --that have--.

COLUMN 12:

Line 31, “a black” should read --black--; and
Line 32, “black” should read --a black.

COLUMN 14:

Line 4, “therein” should read --therein,--;
Line 53, “is” should read --are--; and
Line 63, “By the” should read --By performing the foregoing--.

COLUMN 15:

Line 7, “1” should read --1,--; and
Line 8, “e” should read --e,--.

COLUMN 16:

Line 32, “thereon” should read --thereon,--; and
Line 33, “1” should read --1,--.

COLUMN 17:

Line 4, “thereon” should read --thereon,--; and
Line 5, “1” should read --1,--.

UNITED STATES PATENT AND TRADEMARK OFFICE

CERTIFICATE OF CORRECTION

PATENT NO. : 6,835,110 B2
APPLICATION NO. : 10/212758
DATED : December 28, 2004
INVENTOR(S) : Hironobu Mizuno et al.

It is certified that error appears in the above-identified patent and that said Letters Patent is hereby corrected as shown below:

COLUMN 18:

Line 36 claim 7, "source." should read --sources.--

Signed and Sealed this

Nineteenth Day of February, 2008

JON W. DUDAS
*Director of the United States Patent and Trademark Office*